US011643237B1

(12) United States Patent
Shehadey et al.

(10) Patent No.: US 11,643,237 B1
(45) Date of Patent: May 9, 2023

(54) LIQUID CONTAINER FOR MASS STORAGE, TRANSPORT, AND DISPLAY

(71) Applicant: Shehadey Family Foods, LLC, Reno, NV (US)

(72) Inventors: Richard Shehadey, Fresno, CA (US); Richie Shehadey, Clovis, CA (US); Scott Shehadey, Fresno, CA (US)

( * ) Notice: Subject to any disclaimer, the term of this patent is extended or adjusted under 35 U.S.C. 154(b) by 0 days.

(21) Appl. No.: 17/145,191

(22) Filed: Jan. 8, 2021

Related U.S. Application Data

(63) Continuation-in-part of application No. 16/435,438, filed on Jun. 7, 2019, now abandoned.

(60) Provisional application No. 62/681,897, filed on Jun. 7, 2018.

(51) Int. Cl.
*B65D 1/02* (2006.01)
*B65D 23/10* (2006.01)

(52) U.S. Cl.
CPC ..... *B65D 1/0284* (2013.01); *B65D 1/0246* (2013.01); *B65D 23/10* (2013.01); *B65D 2501/0027* (2013.01)

(58) Field of Classification Search
CPC ..... B65D 1/14; B65D 1/18; B65D 25/2894; B65D 1/0284
See application file for complete search history.

(56) References Cited

U.S. PATENT DOCUMENTS

D604,623 S * 11/2009 Baker, III ..... D9/531
D749,422 S 2/2016 Janeczek
D800,567 S 10/2017 Palmer et al.
9,981,768 B1 5/2018 Palmer et al.
10,259,609 B2 * 4/2019 Kuhar ..... B65D 23/10

FOREIGN PATENT DOCUMENTS

WO 2018044615 A1 3/2018

OTHER PUBLICATIONS

Marketing one sheet publicly distributed at least as early as May 15, 2012.
Trademark specimen filed on May 27, 2016 in connection with U.S. Appl. No. 87/053,163 (U.S. Pat. No. 5,347,987) illustrating prior product sold by applicant, retrieved Jan. 21, 2021 from tsdr.uspto.gov.
Screenshot of article entitled "Walmart opens Fort Wayne milk processing plant", believed to be published on Jun. 13, 2018, retrieved Jan. 21, 2021 from web.archive.org/web/20180614113027/https://www.wane.com/news/local-news/walmart-opens-fort-wayne-milk-processing-plant/1236460858/.
Screenshot of web page illustrating prior product sold by applicant, believed to be published on May 13, 2017, retrieved Jan. 21, 2021 from web.archive.org/web/20170513011815/http://producersdairy.com/products.

* cited by examiner

*Primary Examiner* — Jeffrey R Allen
(74) *Attorney, Agent, or Firm* — Marcus N. DiBuduo; John R. Aaron

(57) ABSTRACT

A thin-walled plastic container for storing liquids having a pour spout on a top and a handle disposed at a point near the pour spout to a point on a front of the container. In preferred embodiments, ridges are formed into portions of the corners and edges of the container and container body to add structural support. The characteristics of the present invention allow for enhanced storage and display capability, easier product transport, and increased durability.

25 Claims, 16 Drawing Sheets

LIQUID CONTAINER FOR MASS STORAGE, TRANSPORT, AND DISPLAY

CROSS-REFERENCE TO RELATED APPLICATIONS

The present application is a continuation-in-part of U.S. nonprovisional patent application Ser. No. 16/435,438, filed Jun. 7, 2019, which claims the benefit of U.S. provisional patent application No. 62/681,897, filed Jun. 7, 2018, each of which are incorporated herein by reference in their entirety.

FIELD OF THE INVENTION

The present invention generally relates to containers which store liquid. More specifically, the present invention relates to molded, thin-walled plastic containers for storing beverages such as milk, water, and juice. In particular, the present invention concerns self-supporting liquid containers designed for mass storage, transport, and display.

BACKGROUND OF THE INVENTION

Molded, thin-walled plastic containers are often used for storing consumer products such as milk, water, and juice. The lightweight design and low cost make such containers highly appealing to product handlers, from the producer down to the consumer. Conventional containers generally have four, typically very thin, walls with a pour spout usually disposed on the top of a container and a handle disposed on a corner of the container body. This conventional lightweight design has certain advantages, as it is relatively cheap to manufacture and reduces load weight during transport. Additionally, for the consumer, it provides for a convenient way to purchase and handle large quantities of liquid. However, conventional containers lack durability and strength and are, therefore, susceptible to damage during storage and transport.

For producers, distributors, and retailers, there exists a need for liquid containers which are: lightweight, but durable; adaptable to a variety of type of stackable shipping boxes and crates; and able to be efficiently and conveniently displayed. Conventional liquid containers often comprise very thin plastic walls, which allows for easier transport and handling, at the expense of structural integrity. To compensate, conventional liquid containers are often secured in boxes or crates during transport, whether it be during transit to a retailer or during the transfer of the product to a display shelf. One problem that arises with some conventional liquid containers is the inability to fit into certain types of boxes or crates. For example, the height of a liquid container may exceed the depth of a crate, thus preventing additional crates from being stacked on top.

In addition to the above, while the lightweight plastic design of conventional liquid containers is advantageous in certain aspects, it may necessitate the type of shipping box or crate being used. For example, due to the fragility of a liquid container, a user may utilize thick plastic crates to transport and stack multiple containers. Crates such as these are generally heavier and more expensive to produce compared to simple cardboard boxes. In other instances, containers may be transported in light, inexpensive cardboard boxes. However, such containers are much more susceptible to damage during transport and/or when they are stacked.

Furthermore, due to the configuration of the handle, when conventional containers are on display or stored with their label facing outward, the handle is typically oriented to the right (when facing the container). Therefore, when a container is picked up by the handle, the container will have a tendency to rotate so that the weight is more evenly distributed when the container is being handled. This means that when the handler grabs a container from a shelf or display, there is an added strain in trying to remove the container from between other containers, as the container must be removed without any lateral rotation. Similar effort is required when stocking and storing conventional containers, as the handler is required to rotate the container as it is being placed. To compensate, a handler may place a hand on the front and/or bottom of the container for support when removing or placing a container.

It is therefore desirable for an improved liquid container which seeks to solve those issues addressed above. The invention described herein is a liquid container which is durable, yet lightweight, having structural features on various corners and sides to prevent bumps and dents and to increase the overall durability. The present invention is also designed to fit a wide variety of conventional types of shipping boxes or crates, allowing for increased adaptability during transport or storage. The presently described invention also allows for the efficient use of display space, by maximizing the quantity of containers that can be displayed at one time, while also providing for easy removal and replacement.

BRIEF SUMMARY OF THE INVENTION

The present invention concerns a self-supporting liquid container comprising a body, handle, pour spout, and removable cap or lid. The container is particularly well suited for beverages such as water, juice, and, in particular, milk. However, it is to be appreciated that the present invention may also be suited for non-beverage liquids such as, but not limited to, detergent or cleaning solution. The features and design of the present invention may allow for increased durability, more efficient use of storage space, and easier product transportation.

In some embodiments, the present invention may comprise a liquid container having a pour spout and a handle, each of which may be integrally formed with the container. A pour spout may be disposed near the center of the top of the container and may comprise a threaded neck on the outer surface of the spout for the attachment and securing of a removable cap or lid. The container may comprise a body having a front, a back, a first side, and a second side, each of which may have a corresponding wall. In preferred embodiments, a handle may be formed by a cut-out portion on the front of the container and the front wall and back wall of the container body may be perpendicular to the first and second side walls. Thus, the surface of the front wall (below the cut-out portion) may be substantially parallel to the surface of the back wall of the container. Likewise, the surface of the first side wall may substantially parallel to the surface of the second side wall.

In certain embodiments, the width of the container (defined by the widest portion of the sides) may be slightly smaller than the length of the container (defined by the widest portion of the front and back of the container). Thus, a horizontal cross-section of the container body, may be generally rectangular. It is to be appreciated, however, that the container body may modified to be any other shape, including square.

In preferred embodiments of the present invention, the handle formed by the cut-out portion of the container may have an inverted "J" shape, which may extend from near the pour spout to a step defined by a lower wall formed by the cut-out portion. An upper wall, formed by the cut-out portion, and the step may form a generally tilted "L" shape (i.e., the angle formed between the adjacent walls may be slightly obtuse). In preferred embodiments, the handle may be disposed near a midpoint on the step, wherein the step may approximate a longitudinal midpoint of the front of the container. In certain embodiments, a handle may have a recessed portion along the surface thereof for the placement of a finger or thumb. Additionally, the width of a handle may vary along a portion thereof.

In some embodiments, the top of the container may be a curved or rounded wall. In certain embodiments, the top wall may be defined as the portion which extends from the neck to the handle and which also extends toward the back wall, first side wall, and second side wall to the transitions where the container surface becomes planar. Integrally formed in the top wall may be small lips or recesses, which may add depth and texture to the surface, while also providing structural support. In certain embodiments, the location of the transition between the top wall and side walls may be different from the location of the transition between the top wall and the back wall of the container. Preferably, the location of the transitions between the top wall and each of the back, first side, and second side walls may be substantially the same (i.e., the transitions lie on the same horizontal plane).

In some embodiments, the distal surface of the container handle may also have planar and curved portions, wherein the transition therebetween may lie substantially along the same horizontal plane as the transitions between the top wall and each of the back, first side, and second side walls. In certain embodiments, the locations of the transition from planar to curved on the distal surface of the handle and the transition between the top wall and back wall of the container may each lie below the locations of the transition between the top wall and the first and second side walls.

In some embodiments of the present invention, one or more vertical edges, which may be defined by the transition from a side wall to a front or back wall of the container body, may be curved or rounded. In preferred embodiments, one or more ridges may be formed into a portion of the container. More specifically, one or more ridges may be formed into and along a portion of a vertical edge of the container body, which may increase the durability and strength of the container by preventing bumps or dents in the container body. In some embodiments, a top wall may comprise one or more edges, which may be curved or rounded and may comprise one or more ridges.

In certain embodiments, a container may have a bottom and a lip which may extend around the perimeter of the container, which may separate the body and the bottom of the container. In some embodiments, the bottom of the container may have a pair of legs which may extend from a bottom wall. In certain embodiments, the bottom wall may have cavity which may be formed as a narrow arch which may have a centerline extending from a midpoint along a vertical centerline of the first side of the container to a midpoint along a vertical centerline of the second side of the container, dividing the bottom wall into two sections. In preferred embodiments, the arch may decrease in height and width as it nears a center point of the bottom of the container, where a tab between the legs may exist. The bottom of the container may also comprise a broad arch along a portion of each of the legs, whose centerline may extend from a midpoint of one leg to a midpoint of the other leg and may be substantially perpendicular to the centerline of the cavity. In preferred embodiments, the maximum height of an arch may be a few millimeters or less and may not extend across the entire width of the bottom of the container. Thus, only a portion of the legs may be in contact with a surface when the container is placed upright.

In some embodiments of the present invention, a container may have a plurality of rounded horizontal bottom edges which may be defined at the intersections between the bottom wall and each of the front, back, first side, and second side walls. In preferred embodiments, a rounded horizontal bottom edge may have one or more ridges. A horizontal bottom edge may also have corners which may be chamfered and one or more ridges may be formed therein, which may increase the strength and durability of the corners.

In some embodiments, a container may have a lip which may extend around a perimeter of the container. In certain embodiments, a lip may form an arch which may be disposed at a side and/or front or back of a container. In some embodiments, a lip may be symmetrical or asymmetrical. For example, the position of a lip may vary between one vertical edge to another vertical edge of a container. In some embodiments a container may have a plurality of ridges which may be non-uniform. For example, a container may have a plurality of ridges of varying lengths and/or widths.

According to some embodiments of the present invention, a container may have one or more ridges which may be integrally formed with a wall on the front of the container. More specifically, one or more ridges may be integrally formed with an upper wall formed by a cut-out portion and disposed above a step formed by the cut-out portion. For example, a ridge may be formed along, or near, an edge of the upper wall. According to some aspects, a ridge may be straight and/or curved and may have a width which may increase or decrease toward an end of the ridge. The curvature of a ridge may generally follow the curvature of an adjacent surface or edge of the container. In some embodiments, a step formed by the cut-out portion of a container may have one or more chamfered or beveled edges. More specifically, the corners of the step (i.e., at the intersections between the step and vertical edges of the front wall of the container), may be chamfered.

In accordance with some embodiments of the present invention, a container for storing liquids may be self-supporting and may comprise: a) a top which may have a wall with an integrally formed pour spout; b) a body comprising a front, a back, a first side, and a second side, each of which may have a wall, wherein the front wall and the back wall may be each perpendicular to the first side wall and the second side wall; c) a handle which may have a recess and which may be medially disposed on the front of the container between the top wall and the front wall, wherein a width of the handle may increase near the top wall and the front wall; d) a bottom which may have a substantially rectangular perimeter and may comprise a first leg and a second leg which may extend from a bottom wall; e) a plurality of rounded vertical edges, wherein a first, second, third, and fourth thereof may be defined at an intersection between the front wall and the first side wall, the front wall and the second side wall, the back wall and the first side wall, and the back end and the second side, respectively; f) a plurality of rounded horizontal bottom edges, wherein a first, second, third, and fourth thereof may be defined at an intersection between the bottom wall and the first side wall, the front wall, the second side wall, and the back wall, respectively; g) at least one lip which may extend along a perimeter of the container and which may form at least one arch along the perimeter; h) at least one recess which may be formed at the top of the container; and i) a collar which may comprise at least one lip which may encircle the pour spout.

In certain embodiments, at least one of the bottom edges and/or at least one of the vertical edges of the container may further comprise at least one integrally formed ridge. In some embodiments, at least one of the bottom edges may further comprise at least one chamfered corner. In a further embodiment, a chamfered corner may comprise at least one integrally formed ridge.

In some embodiments of the present invention, the bottom of the container may comprise a cavity which may extend from a midpoint of the first side to a midpoint of the second side and along a centerline of the bottom. In certain embodiments, a cavity may be formed between the first leg and the second leg of the bottom of the container. In some embodiments, the bottom of the container may comprise an arch extending from a midpoint of the front to a midpoint of the back and along a centerline of the bottom.

In some embodiments of the present invention, the container may comprise at least one volumetric plug.

In some embodiments, a lip extending along a perimeter of the container may form a first arch at the first side, a second arch at the second side, and a third arch at the back of the body of the container.

In some embodiments, the container may further comprise a cut-out portion on the front of the container and the cut-out portion may form an upper wall and a step. In a further embodiment, the upper wall may comprise at least one integrally formed ridge. In some embodiments, an integrally formed ridge may be disposed above the step. In some embodiments, the step may comprise at least one chamfered corner.

In accordance with some embodiments of the present invention, a plastic self-supporting container may be used for storing liquids and may comprise: a rectangular body having a first side, a second side, a front, and a back, each having a wall, wherein the first side wall may be parallel to the second side wall, wherein the front wall may be parallel to the back wall, wherein the first side wall may be perpendicular to the front wall, wherein a rounded vertical edge may be defined at each intersection between the front wall and the first side wall, the front wall and the second side wall, the back wall and the first side wall, and the back wall and the second side wall, wherein the vertical edge of each intersection may comprise an integrally formed ridge, and wherein the first side wall, the second side wall, the front wall, and the back wall may each comprise a planar surface; a top having a wall with an integrally formed pour spout, wherein the wall may comprise a rounded surface; a handle which may be integrally formed with the wall of the top and the front wall, wherein the handle may have a width decreasing in diameter towards the front wall; and a first horizontal edge, a second horizontal edge, a front horizontal edge, and a back horizontal edge, wherein each may be rounded, wherein the first horizontal edge and the second horizontal edge may each comprise a plurality of integrally formed ridges, and wherein the corners of the first horizontal edge, the second horizontal edge, the front horizontal edge, and the back horizontal edge may be chamfered and may comprise an integrally formed ridge; a bottom comprising a cavity extending from a midpoint of the first side of the body to a midpoint of the second side of the body along a centerline of the bottom, wherein the bottom may comprise an arch extending from a midpoint of the front of the body to a midpoint of the back of the body along a centerline of the bottom, wherein the arch may have a centerline perpendicular to a centerline of the cavity.

In some embodiments, a lip may extend along a perimeter of the container and may define a lower boundary of the body. In certain embodiments, the lip may form an arch on each the first side wall, the second side wall, and the back wall of the body.

In accordance with some embodiments of the present invention, a container for liquid may adapted to be displayed on a shelf and may comprise: a) a top wall which may have an integrally formed pour spout; b) a bottom wall which may comprise a first leg and a second leg extending therefrom; c) a front wall and a back wall which may be between the top wall and the bottom wall; d) a first side wall and a second side wall, each which may be between the top wall and the bottom wall, wherein the first side wall and the second side wall may be each perpendicular to the front wall; e) a lip which may extend along a perimeter of the container and which may form an arch on each of the first side wall, the second side wall, and the back wall; f) a handle which may have a top portion which may be integrally formed with the top wall near the pour spout and a bottom portion which may be integrally formed with the front wall; g) at least one integrally formed ridge; h) at least one recess which may be formed in the top wall; and i) a collar which may have at least one lip which may encircle the pour spout; wherein the handle may extend perpendicular to the front wall and the bottom portion of the handle may be about equidistant from the first side wall and the second side wall and wherein the bottom wall may comprise at least one integrally formed ridge and at least one chamfered corner.

In some embodiments, a chamfered corner of the bottom wall may further comprise at least one integrally formed ridge.

In some embodiments, the bottom wall may comprise a cavity which may extend from a midpoint of the first side wall to a midpoint of the second side wall and along a centerline of the bottom wall.

In some embodiments, a cavity may be formed between the first leg and the second leg of the bottom wall.

In some embodiments, the bottom wall may comprise an arch which may extend from a midpoint of the front wall to a midpoint of the back wall and along a centerline of the bottom wall.

In some embodiments, the container may further comprise a cut-out portion which may form an upper wall and a step and wherein the upper wall may be between the top wall and the step. In a further embodiment, the upper wall may comprise at least one integrally formed ridge. In a further embodiment, an integrally formed ridge may be disposed above the step. In some embodiments, the step may comprise at least one chamfered corner.

In accordance with some embodiments of the present invention, a container for liquid may be adapted to be displayed on a shelf, wherein the container may comprise: a) a lip which may extend along a perimeter of the container, wherein the lip may form an arch on each of a first side, a second side, and a back of the container; b) at least one recess which may be formed on a top of the container; c) a collar which may comprise at least one lip which may encircle a pour spout; and d) a cut-out portion on a front of the container, wherein the cut-out portion may form a handle, an upper wall, and a step, wherein the upper wall may comprise at least one integrally formed ridge disposed above the step and wherein the step may comprise at least one chamfered corner.

DETAILED DESCRIPTION OF THE INVENTION

Figure 1:
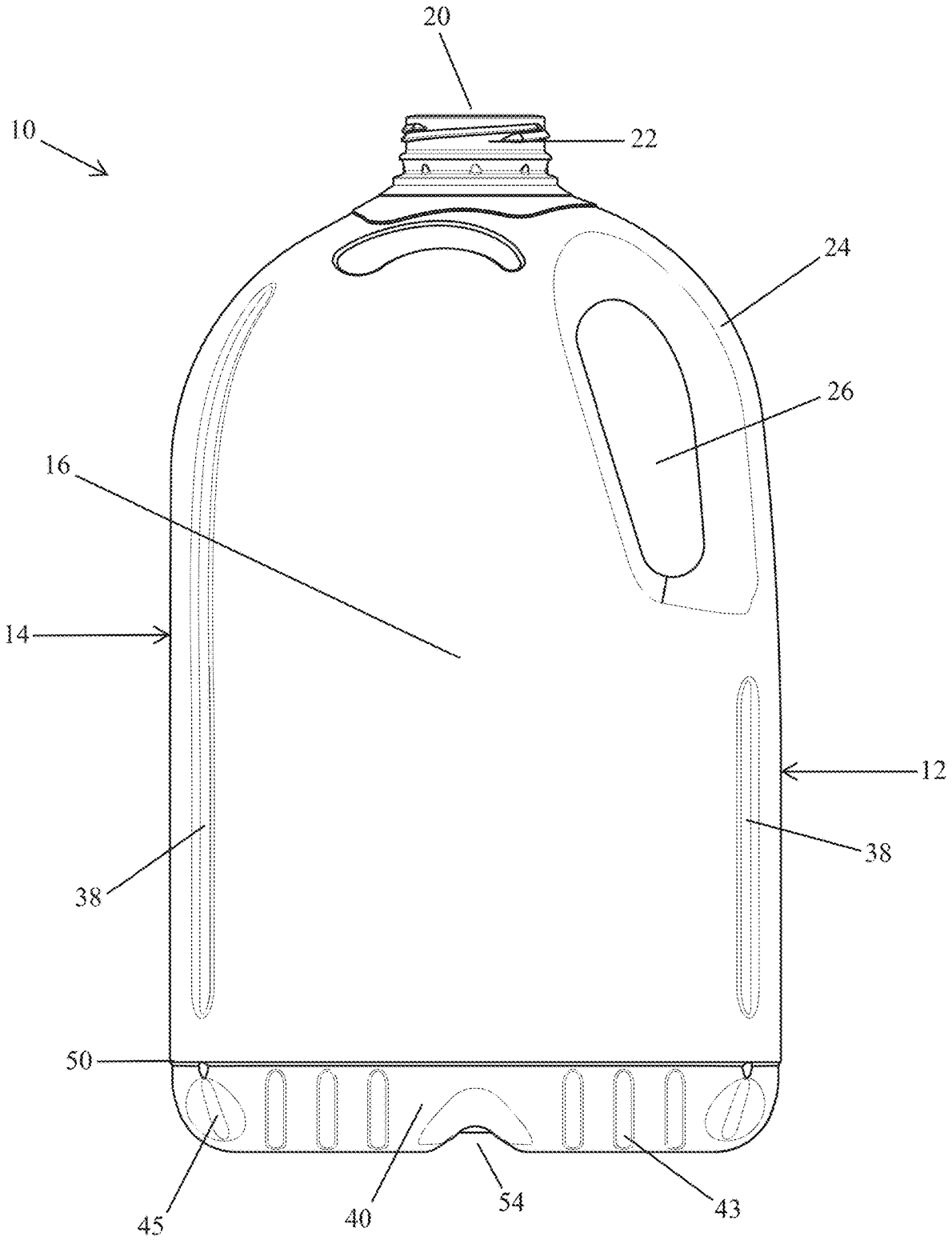
FIG. 1 is a side view diagram illustrating an exemplary liquid container in accordance with some embodiments of the present invention.

The invention, in its various aspects, will be explained in greater detail below. While the invention will be described in conjunction with several exemplary embodiments, the exemplary embodiments themselves do not limit the scope of the invention. Similarly, the exemplary illustrations in the accompanying drawings, where like elements have like numerals, do no limit the scope of the exemplary embodiments and/or invention, including any length, angles, or other measurements provided. Rather the invention, as defined by the claims, may cover alternatives, modifications, and/or equivalents of the exemplary embodiments.

According to some embodiments of the present invention, a liquid container may have a generally rectangular body, a pour spout at a top, and a handle at a front. For example, as illustrated in FIGS. 1-4, a liquid container 10 may comprise a body with a front, back, first side, and second side having a front wall 12, back wall 14, first side wall 16, and second side wall 18 (on the other side of first side wall 16), respectively. In preferred embodiments, a pour spout 20, having a neck 22, may be disposed near a center of a top of container 10. In certain embodiments, a neck of a pour spout may be threaded for the attachment and securing of a removable cap or lid. Container 10 may also have a handle 24, which may be formed by a cut-out portion 26 of container 10.

Figure 2:
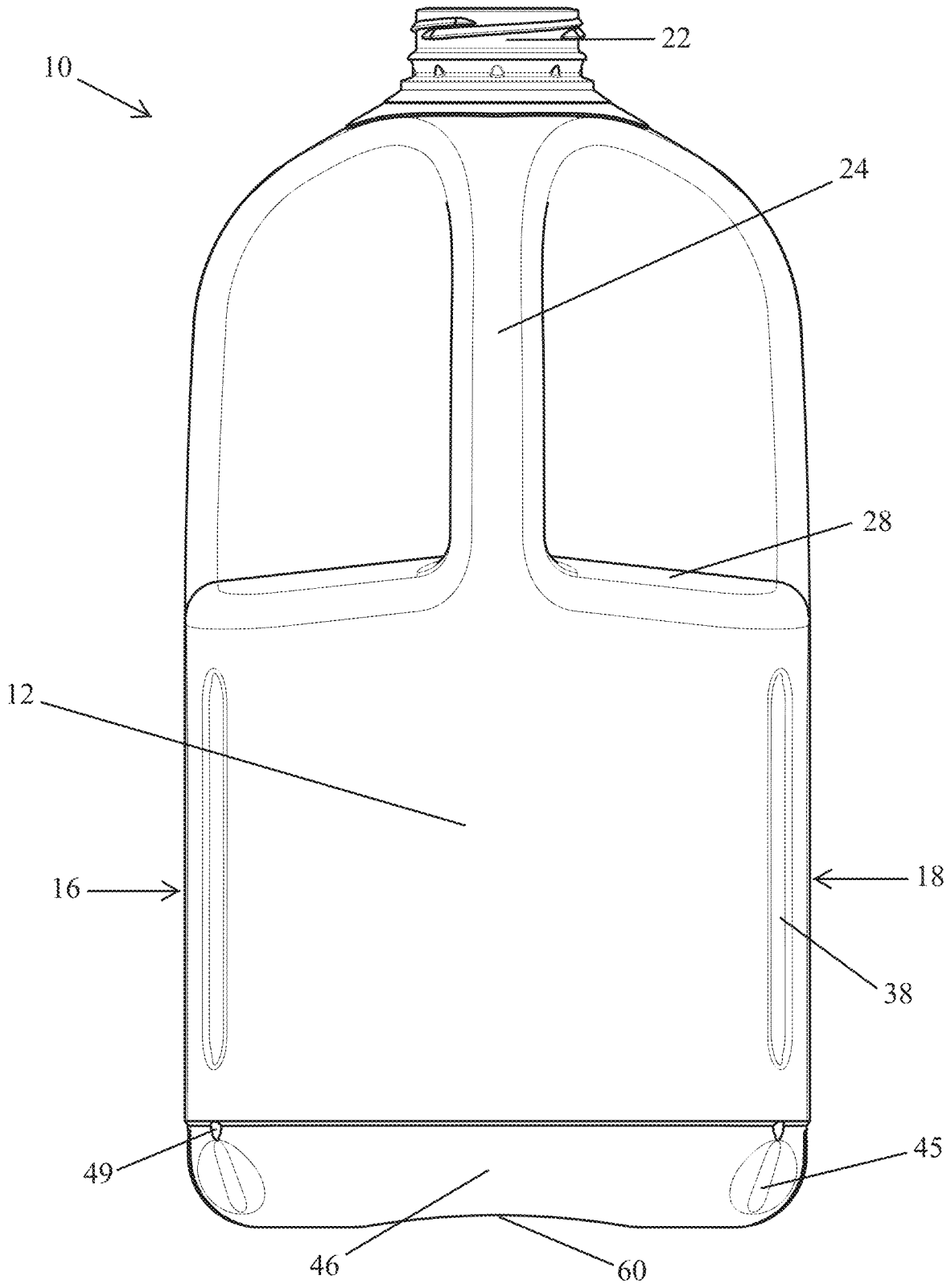
FIG. 2 is a front view diagram of the liquid container illustrated in FIG. 1
Figure 3:
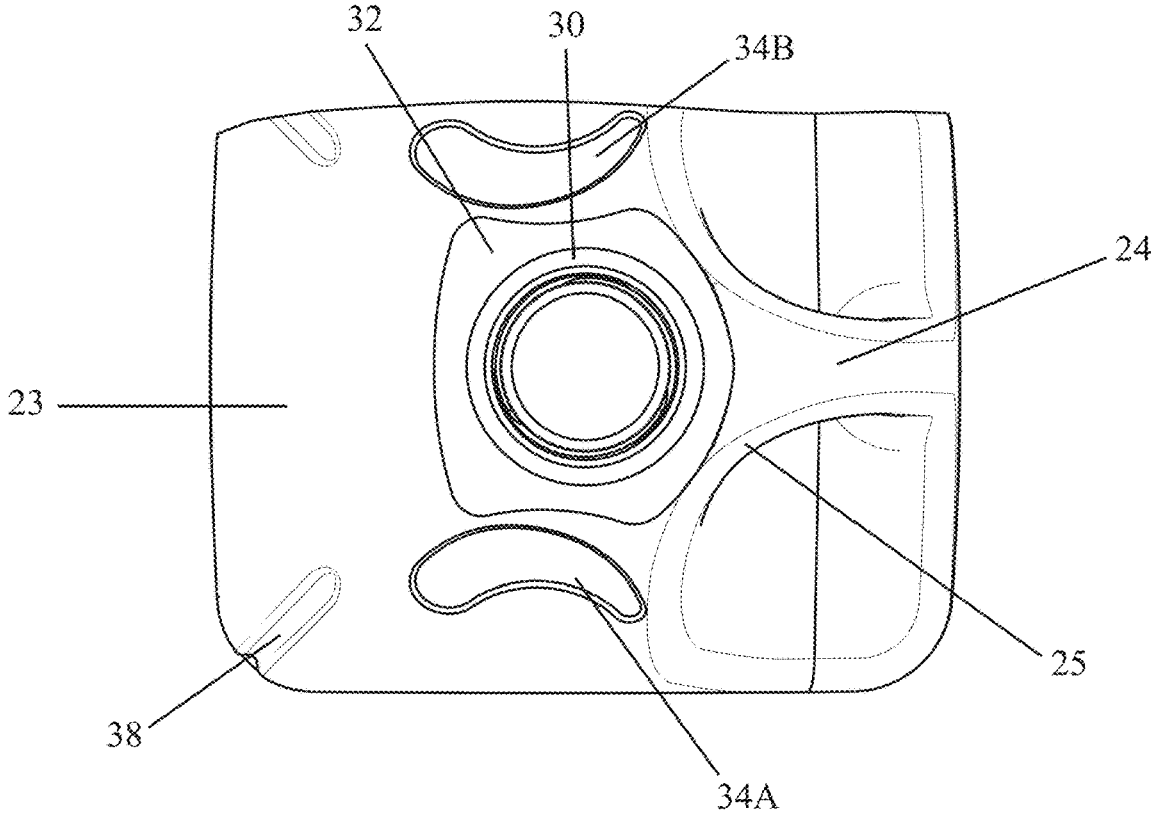
FIG. 3 is a partial top view diagram of the liquid container illustrated in FIG. 1.

In some embodiments, a container may have a handle formed along, or near, a vertical centerline of a side, front, or back of the container. For example, as illustrated in FIGS. 1-3, handle 24 may extend from a point near neck 22 to a point approximately defining a horizontal midpoint of a step 28. Handle 24 may be rounded at a top portion thereof, thereby forming an inverted "J" shape (as best shown in FIG. 1). In some embodiments, a distal surface of a handle (i.e., the surface facing away from the center of a container) may have a recess for the placement of one or more fingers. By having handle 24 disposed on the front, container 10 can have a label (not shown) and handle 24 oriented in the same direction. Advantageously, by having a label and handle oriented in the same direction, a container can be placed on a display shelf with the label and handle facing toward the view of a passing consumer. Furthermore, it is to be appreciated that, advantageously, by having the handle and label oriented in the same direction, the need may be eliminated for a container to be rotated when being placed on, or removed from, a shelf or display.

In preferred embodiments, step 28, which may be formed by the cut-out portion 26, may be located along a plane approximately defining a vertical midpoint of the front of the container. However, it is to be appreciated that a step may be disposed above or below a vertical midpoint of the front of a container. As best seen in FIG. 2, step 28 may be slightly upwardly bowed, that is, the height of the top surface of step 28 may slightly decrease in a distal direction (i.e., away from handle 24). In some embodiments, a step may have corners which may be beveled or chamfered. However, it is to be appreciated that a step may be substantially horizontal, downwardly bowed, rounded, or any other shape.

In preferred embodiments, a handle may be integrally formed with a container body and the width of the handle may vary along a portion thereof. For example, as best viewed in FIG. 3, the width of handle 24 may increase as it approaches neck 22 of container 10. Handle 24 may also be integrally formed with container 10, such that the gradual change in width forms smooth curves 25 which extend along the sides of the top portion of handle 24 into the surface of the cut-out portion 26 and along the edges between cut-out portion 26 and the top of container 10.

In preferred embodiments, a liquid container may be formed from plastic material, such as high density polyethylene (HDPE), or the like. A typical volume of a container may be about one gallon (128 fl oz). However, it is to be appreciated that the size of a container may be adapted to store other volumes such as quart (32 fl oz) or half-gallon (64 fl oz) sizes.

In some embodiments of the present invention, the top of a container may have a wall which may be curved or rounded toward the neck of the pour spout and, in preferred embodiments, the surfaces of the front wall, back wall, and sides of the container may be planar. For example, a lower boundary of a top wall 23 of container 10 may extend from neck 22 to handle 24 and to front wall 12, back wall 14, first side wall 16, and second side wall 18, where the intersections of top wall 23 with each of the front wall 12, back wall 14, first side wall 16, and second side wall 18 may be defined by the transitions from a curved, or rounded, surface to a planar surface. In preferred embodiments, a distal surface of a container handle may have both planar and rounded portions which may be continuous with the surfaces of a front wall and a top wall, respectively, of the container.

In some embodiments, a front wall and back wall of a container may be perpendicular to each of the sides of a container. That is, the surfaces of the front wall and back wall may be parallel to each other. Similarly, the surfaces of each side wall of a container may be parallel to each other.

Figure 5:
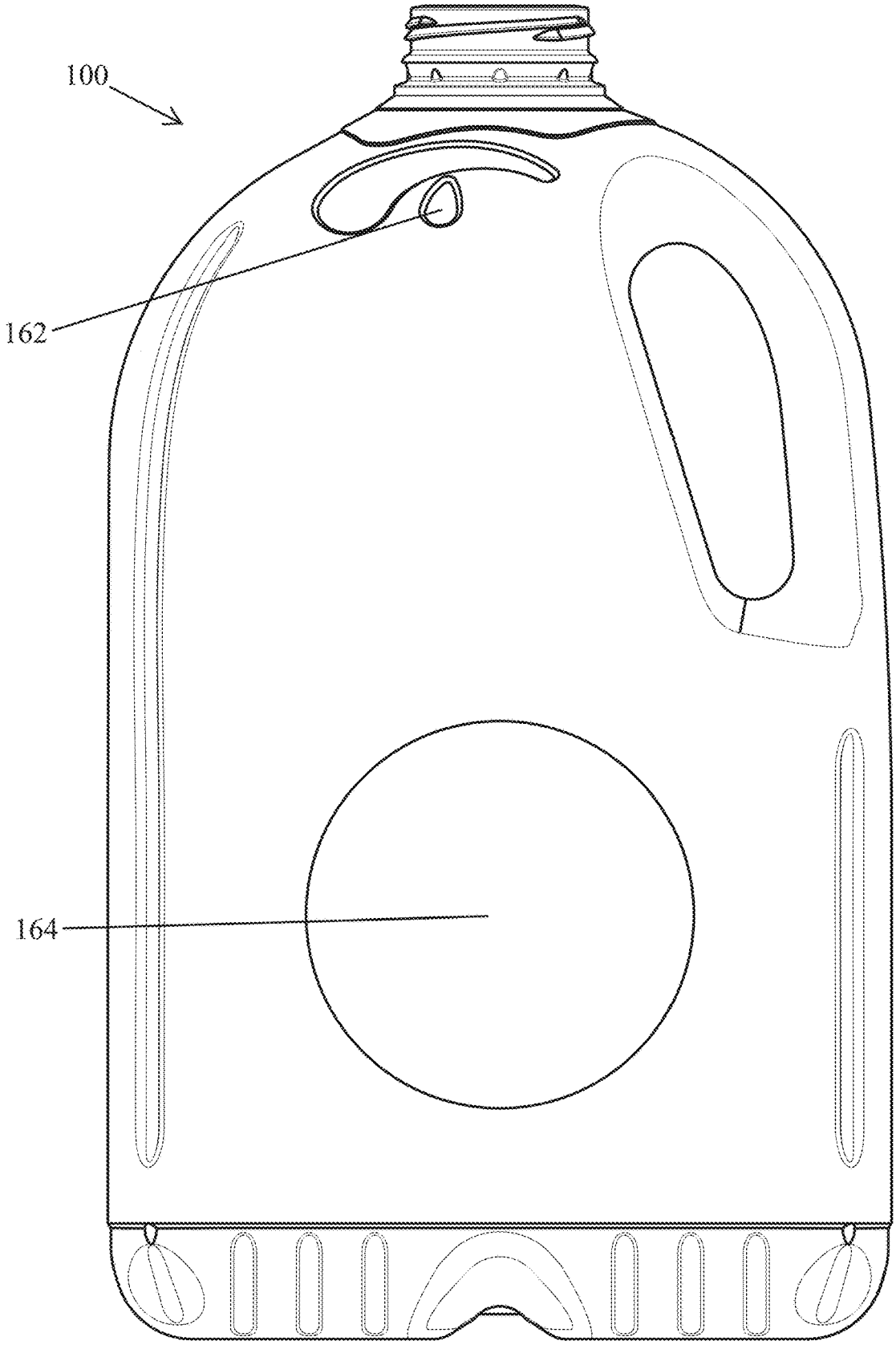
FIG. 5 is a side view diagram illustrating an exemplary liquid container in accordance with some embodiments of the present invention.

In some embodiments of the present invention, a liquid container may include one or more integrally formed lips or recesses, which may provide structural support to a container when pouring a liquid or when other containers and items are stacked on top of the container. In certain embodiments, a liquid container may have a collar comprising one or more lips encircling a pour spout at a top of the container. For example, as illustrated in FIG. 3, a first lip 30 may be disposed below neck 22 of container 10, forming a thin protruding surface, relative to the surface of a second lip 32. Second lip 32, which may be irregularly shaped, may also form a thin protruding surface, relative to the remaining surface of top wall 23. It is to be appreciated that a container may have a plurality of lips which may be regularly or irregularly shaped and may form protruding surfaces of various thicknesses. Adjacent to first lip 30 and second lip 32, in the direction of first side wall 16 and second side wall 18, may be a pair of recesses 34A and 34B, respectively. As shown best in the illustration of FIG. 3, recesses 34A and 34B may be, generally, comma shaped and may be very shallow (<1 mm). However, it is to be appreciated that a container may include recesses of various shapes and depths, in accordance with some embodiments of the present invention. For example, as illustrated in FIG. 5, a liquid container 100 may have a tear drop shaped recess 162 formed at a top of container 100.

Figure 12:
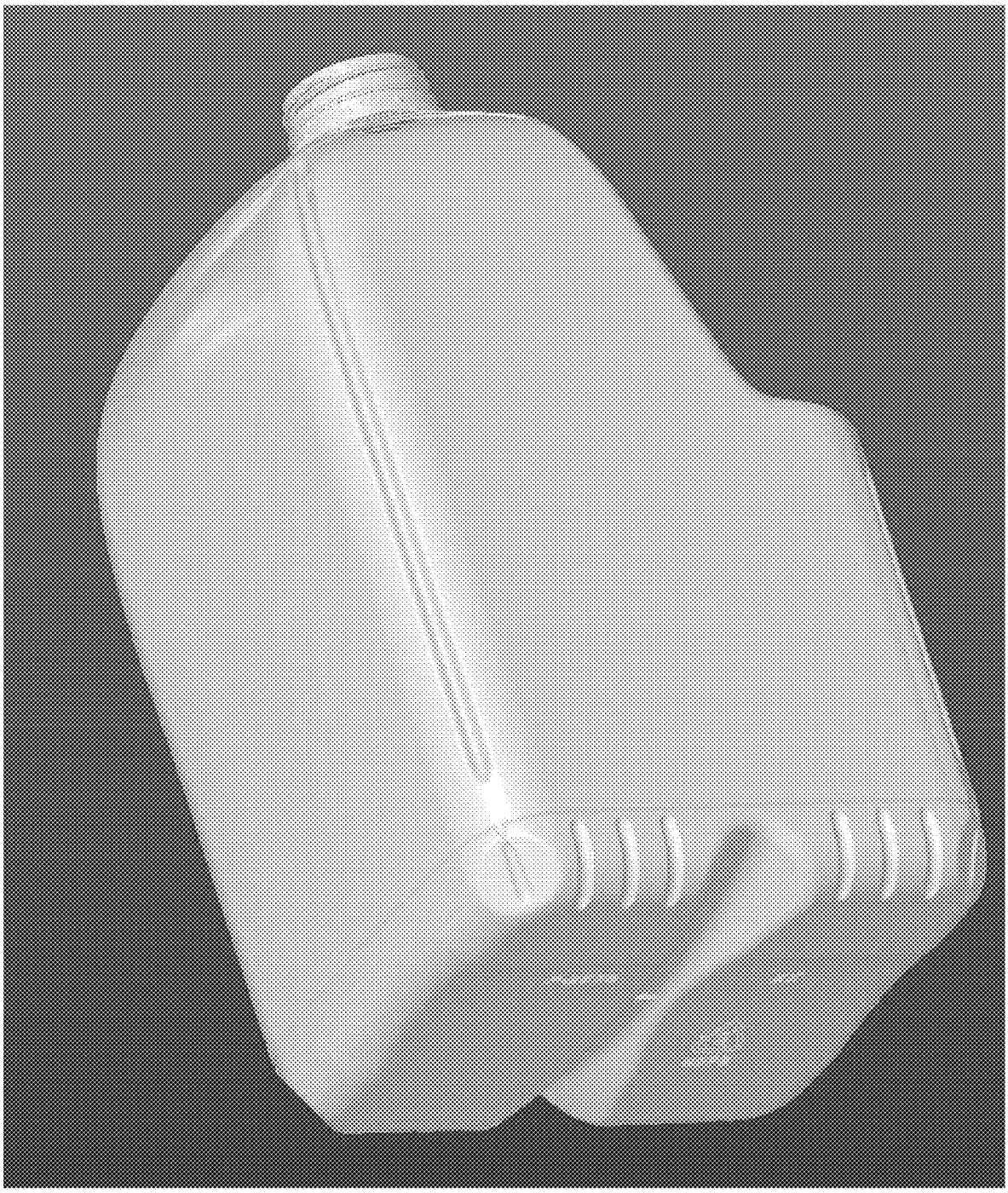
FIG. 12 is a bottom perspective view diagram illustrating an exemplary liquid container in accordance with some embodiments of the present invention.
Figure 13:
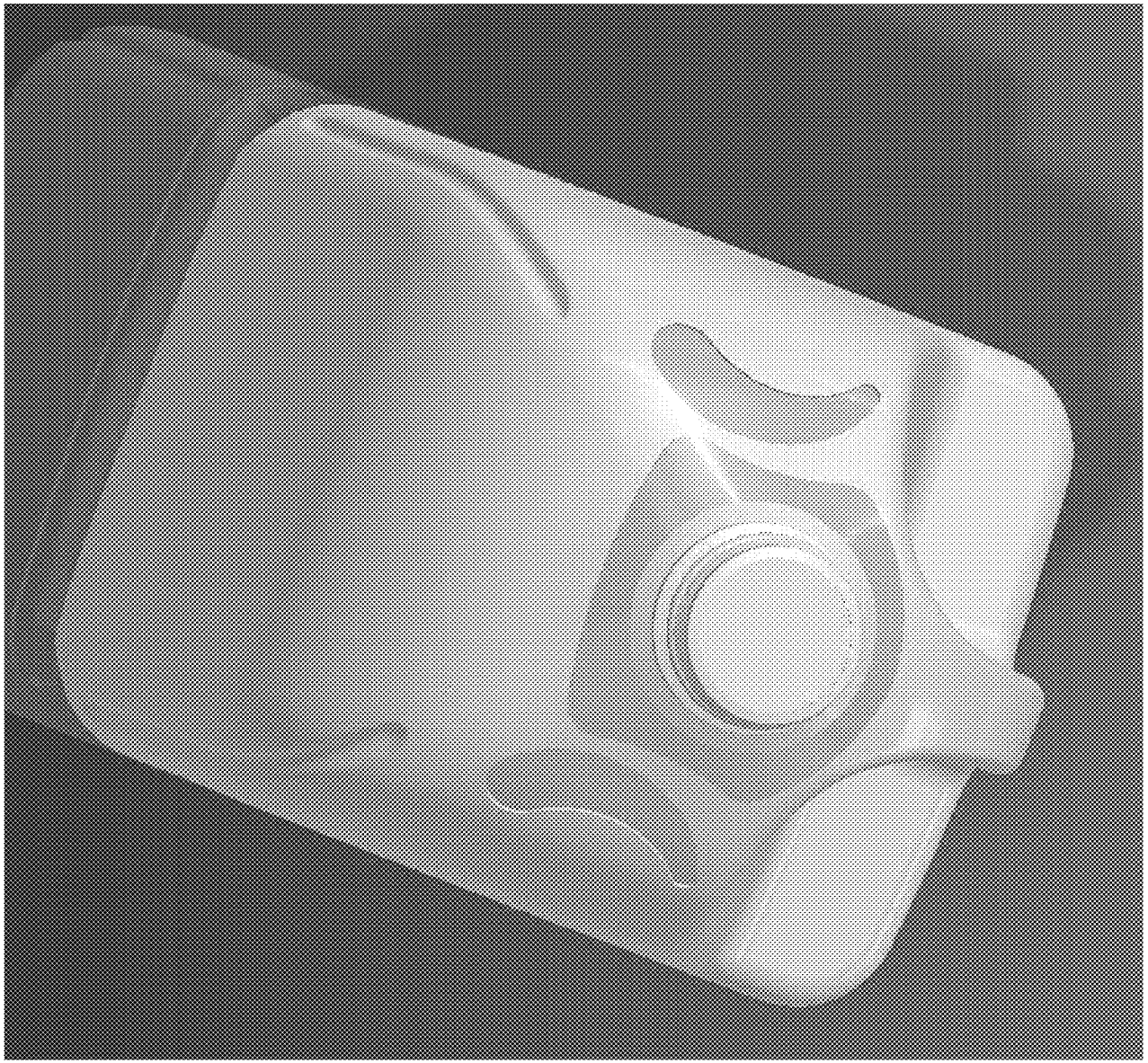
FIG. 13 is a top perspective view diagram illustrating an exemplary liquid container in accordance with some embodiments of the present invention.
Figure 14:
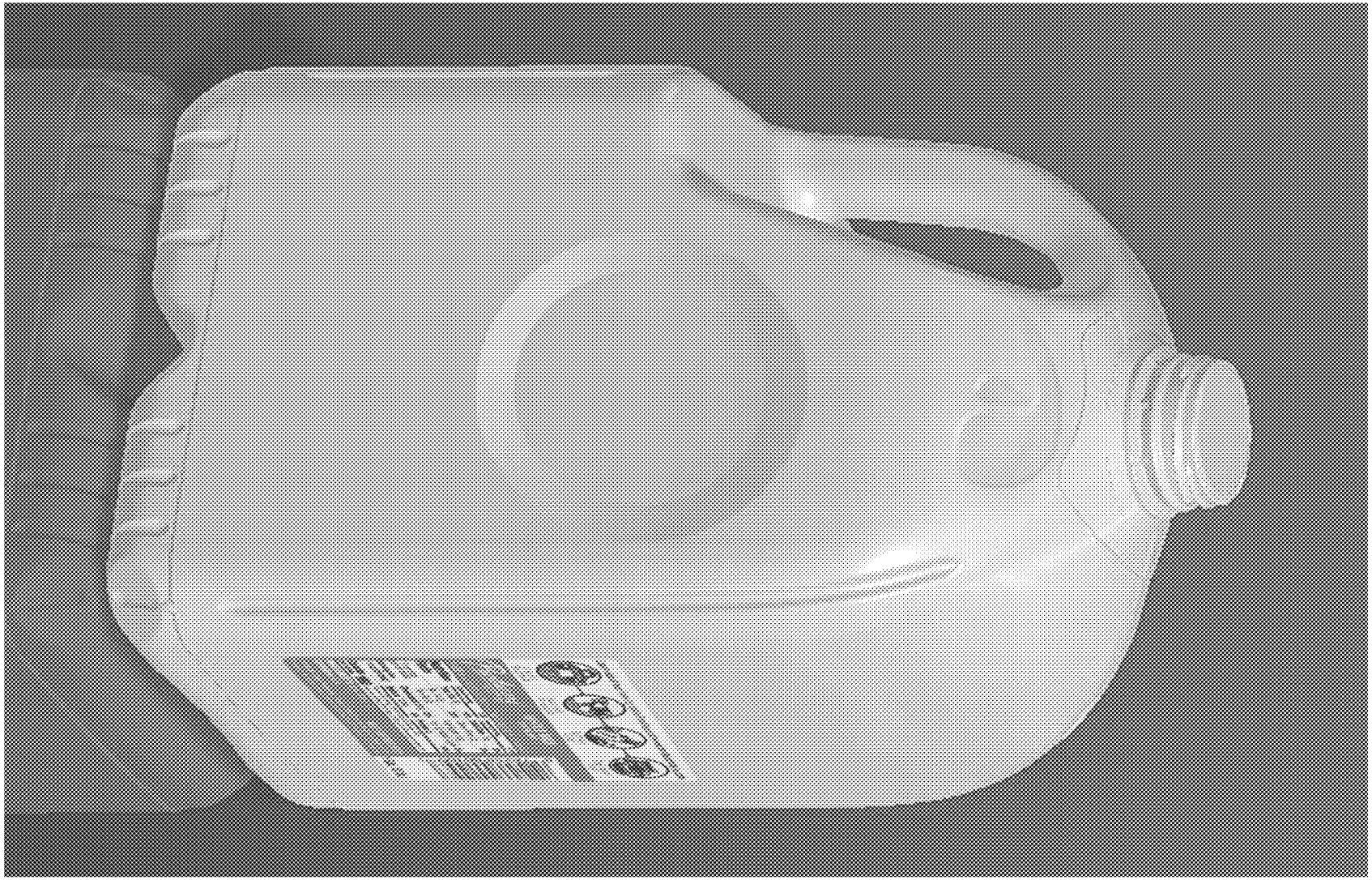
FIG. 14 is a side perspective view diagram illustrating an exemplary liquid container in accordance with some embodiments of the present invention.
Figure 15:
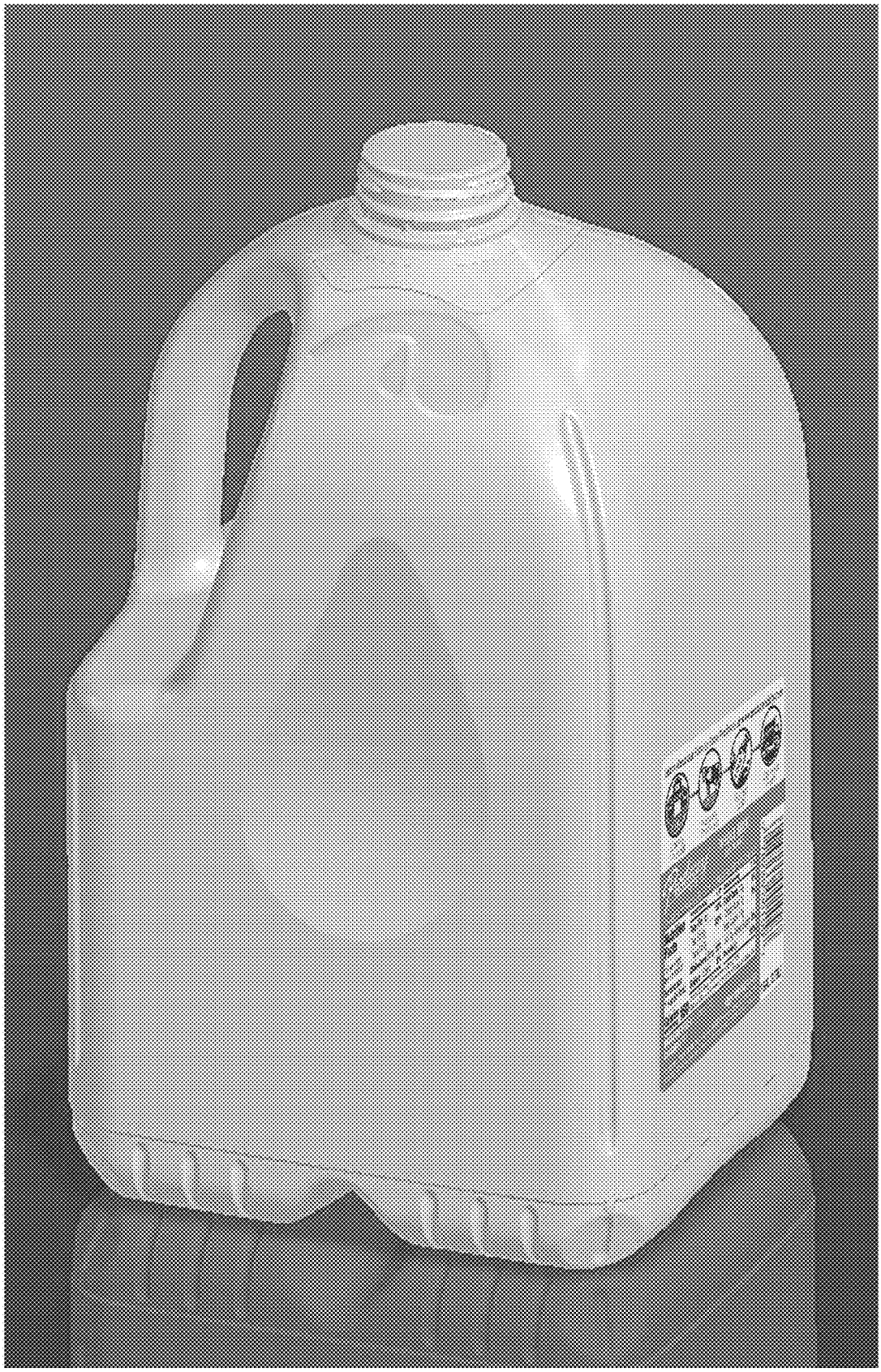
FIG. 15 is a side perspective view diagram illustrating an exemplary liquid container in accordance with some embodiments of the present invention.
Figure 16:
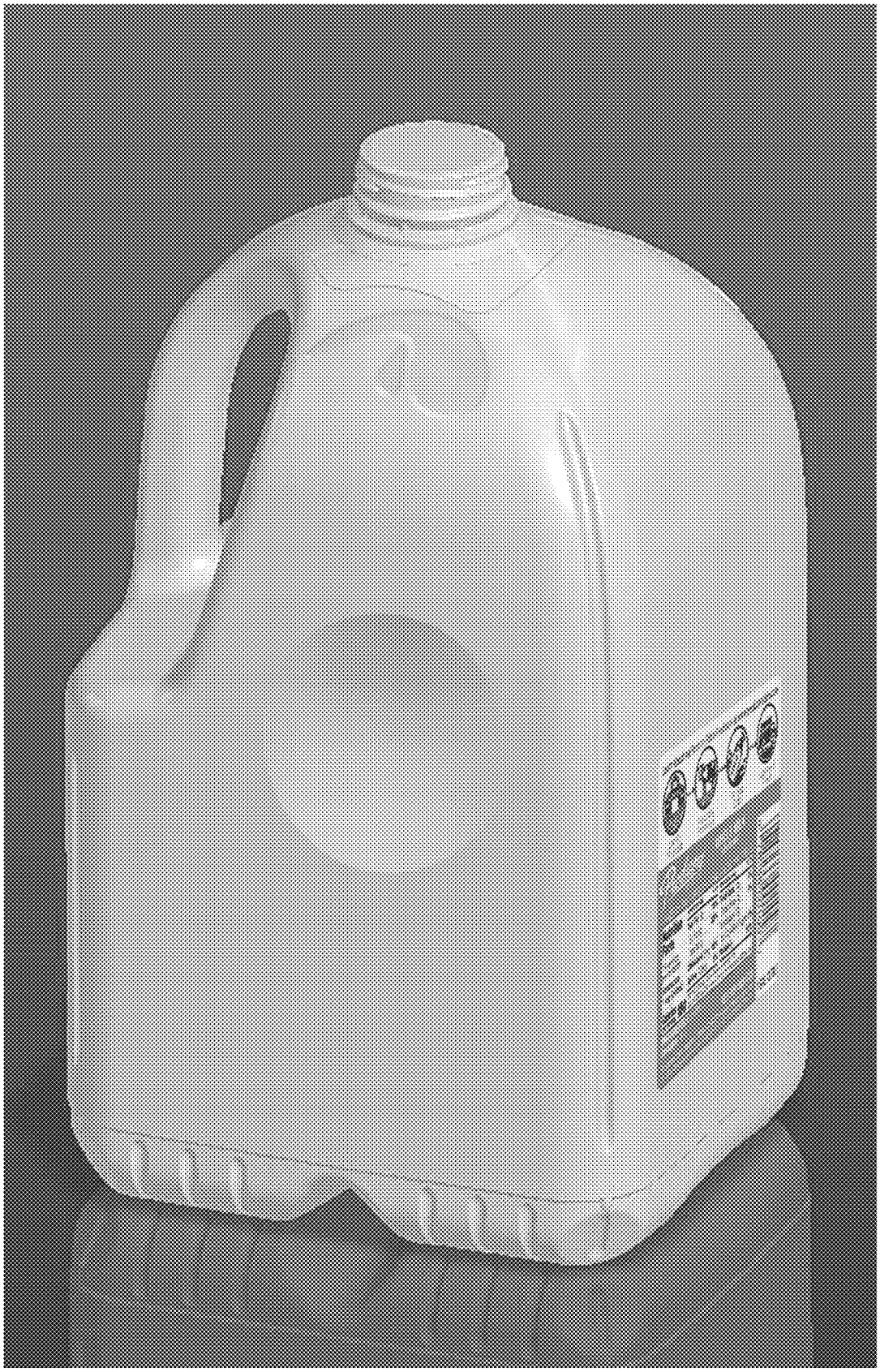
FIG. 16 is a side perspective view diagram illustrating an exemplary liquid container in accordance with some embodiments of the present invention.
Figure 17:
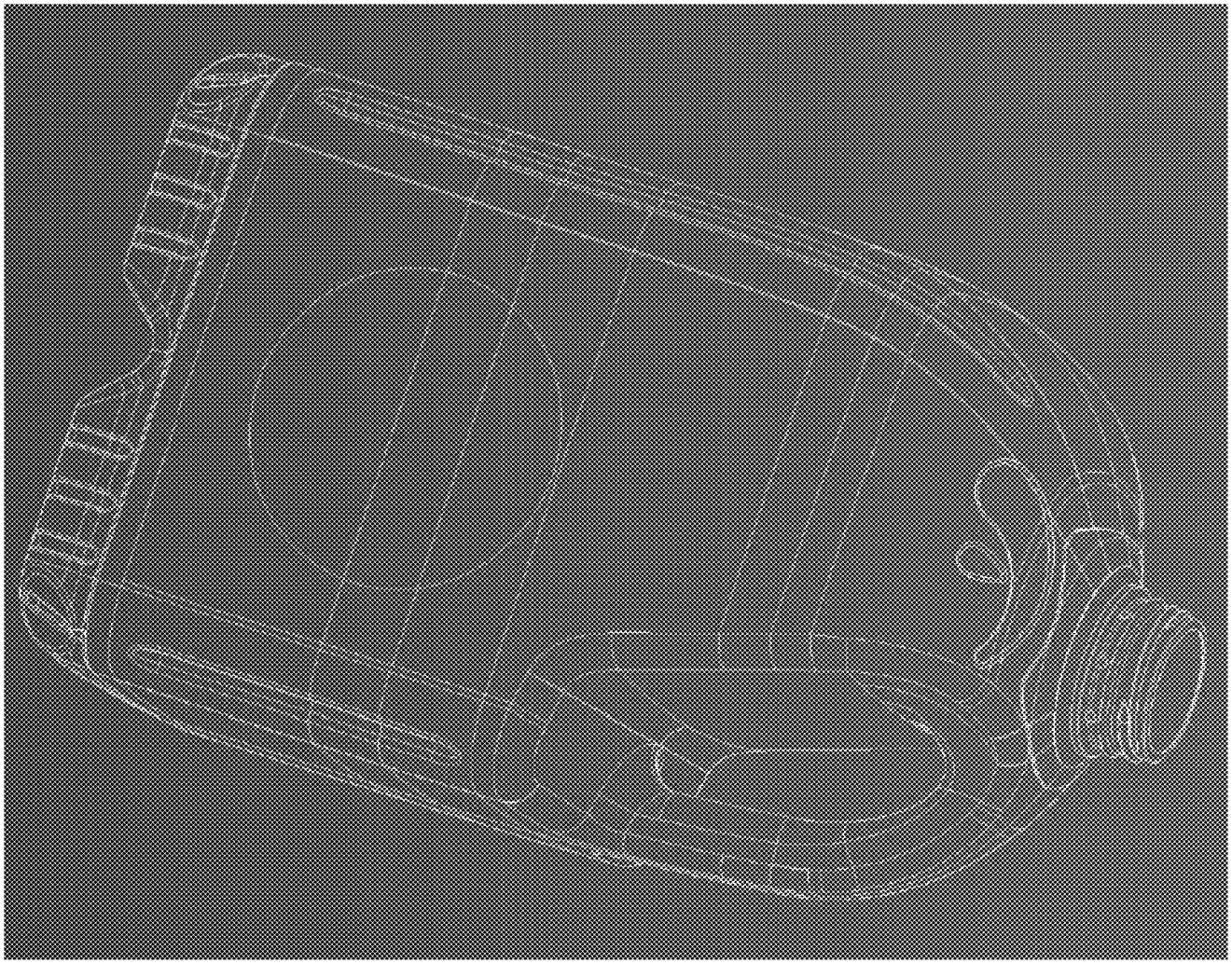
FIG. 17 is a side perspective view diagram illustrating an exemplary liquid container in accordance with some embodiments of the present invention.

In some embodiments of the present invention, a volumetric plug may be formed in the body of a liquid container, which may be provided in order to compensate for variations in weight between filled containers. In some embodiments, the weights between filled containers may range from about 10 to 50 grams. For example, as further illustrated in FIG. 5, a circular volumetric plug 164 may be integrally formed into a side of container 100. It is to be appreciated, however, that a volumetric plug may be any shape and may be concave or recessed. For example, a volumetric plug may be circular and recessed, tear drop shaped and concave, or circular and concave, as illustrated in FIGS. 12-14, respectively.

According to some embodiments of the present invention, the rear corner edges of a container (i.e., the transitions between side walls and a back wall) may be rounded. Similarly, the front corner edges of a container (i.e., the transitions between side walls and a front wall), which may extend below a step at a front of the container, may also be rounded. In some embodiments, one or more ridges may be formed along a portion of a corner edge, which may provide durability and strength to a container by preventing bumps, dents, or any other kind of structural damage. For example, as illustrated in FIGS. 1-3, the corner edges of container 10 may comprise one or more elongated ridges 38 along a portion of a corner edge.

Referring, generally, to FIGS. 1 and 2, container 10 may include a first horizontal bottom edge 40, a second horizontal bottom edge (on the other side of first horizontal bottom edge 40; not illustrated), a third horizontal bottom edge 46, and a fourth horizontal bottom edge (on the other side of third horizontal bottom edge 46; not illustrated), each of which may be disposed below a lower lip 50, whereat the width of container 10 may decrease slightly. In preferred embodiments, one or more horizontal bottom edges may be rounded.

In some embodiments, a horizontal bottom edge may also have one or more ridges formed therein. For example, as illustrated in FIG. 1, a plurality of ridges 43 may be formed into first horizontal bottom edge 40. In preferred embodiments, a horizontal bottom edge may have one or more corners which may be chamfered and may have one or more ridges formed therein. For example, a corner ridge 45 may be formed into a chamfered corner of first horizontal bottom edge 40. In preferred embodiments, a corner ridge may extend along a longitudinal centerline of a chamfered corner. Corner ridges may help prevent bumps or dents from forming in a corner of a container. To further increase structural integrity, in some embodiments, a container may also comprise one or more protrusions. For example, a protrusion 49 may be formed between a chamfered corner of a horizontal bottom edge and lip 50 (see, e.g., FIG. 2)

Figure 4:
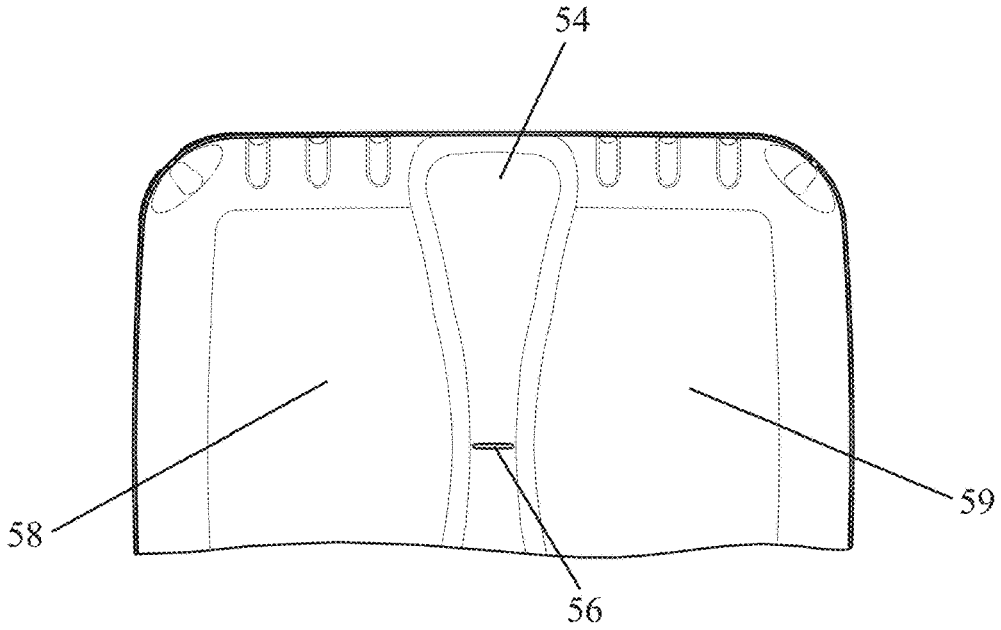
FIG. 4 is a partial bottom view diagram of the liquid container illustrated in FIG. 1.

Referring, generally, to FIG. 4, a bottom of container 10 may have a first leg 58 and a second leg 59 extending from a bottom wall and divided by a cavity 54. In some embodiments, a cavity may be formed along the entire length or width of a container such that the cavity may be visible from a side of the container (see, e.g., FIG. 1). A cavity may have rounded or planar surfaces which may be continuous or discontinuous (e.g., sharp or jagged topographical changes, transitions from a rounded to a planar surface, changes in thickness, etc.). In preferred embodiments, a cavity may decrease in both width and height from a point near a midpoint of the horizontal bottom edges to a point near the center of the bottom of the container. Near this center may exist a tab which may be formed within a cavity of a container. For example, a tab 56 may be disposed near the center of the bottom of the container, between first leg 58 and second leg 59, and oriented approximately perpendicular to a longitudinal centerline of cavity 54.

In some embodiments, the bottom of a container may be arched or bowed. For example, first leg 58 and second leg 59 may include arch 60 which may be visible from the front or back of container 10, as illustrated in FIG. 2. In preferred embodiments, an arch may have a centerline which may pass through the center of the bottom of a container, extending from front to back. Arch 60 may also be substantially perpendicular to cavity 54 and may be broadly and slightly arched, so that only portions of first leg 58 and second leg 59 are in contact with a surface when container 10 is standing upright (as best seen in FIG. 2). It is to be appreciated that the presence of an arch and/or cavity may provide structural support to a container.

Figure 6:
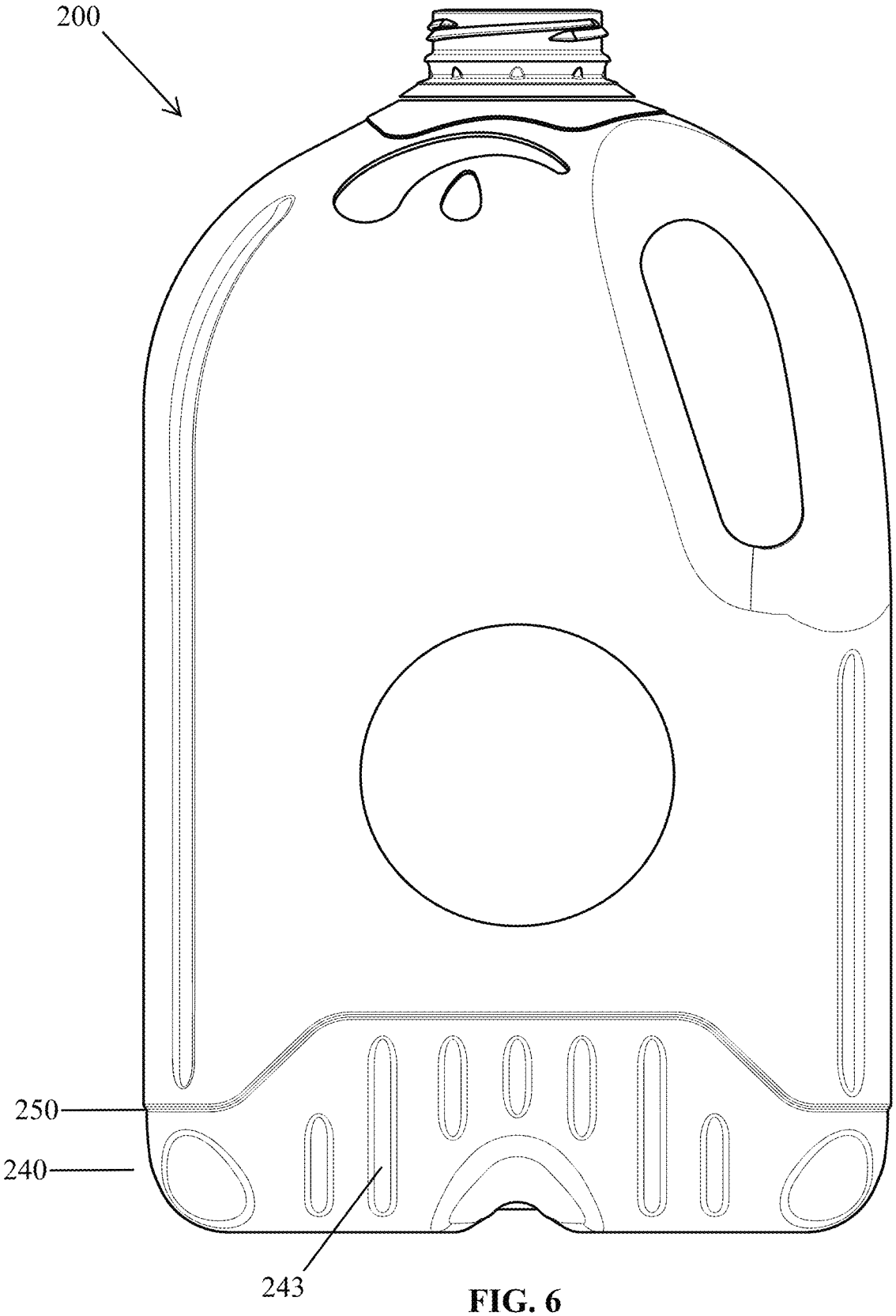
FIG. 6 is a side view diagram illustrating an exemplary liquid container in accordance with some embodiments of the present invention.
Figure 7:
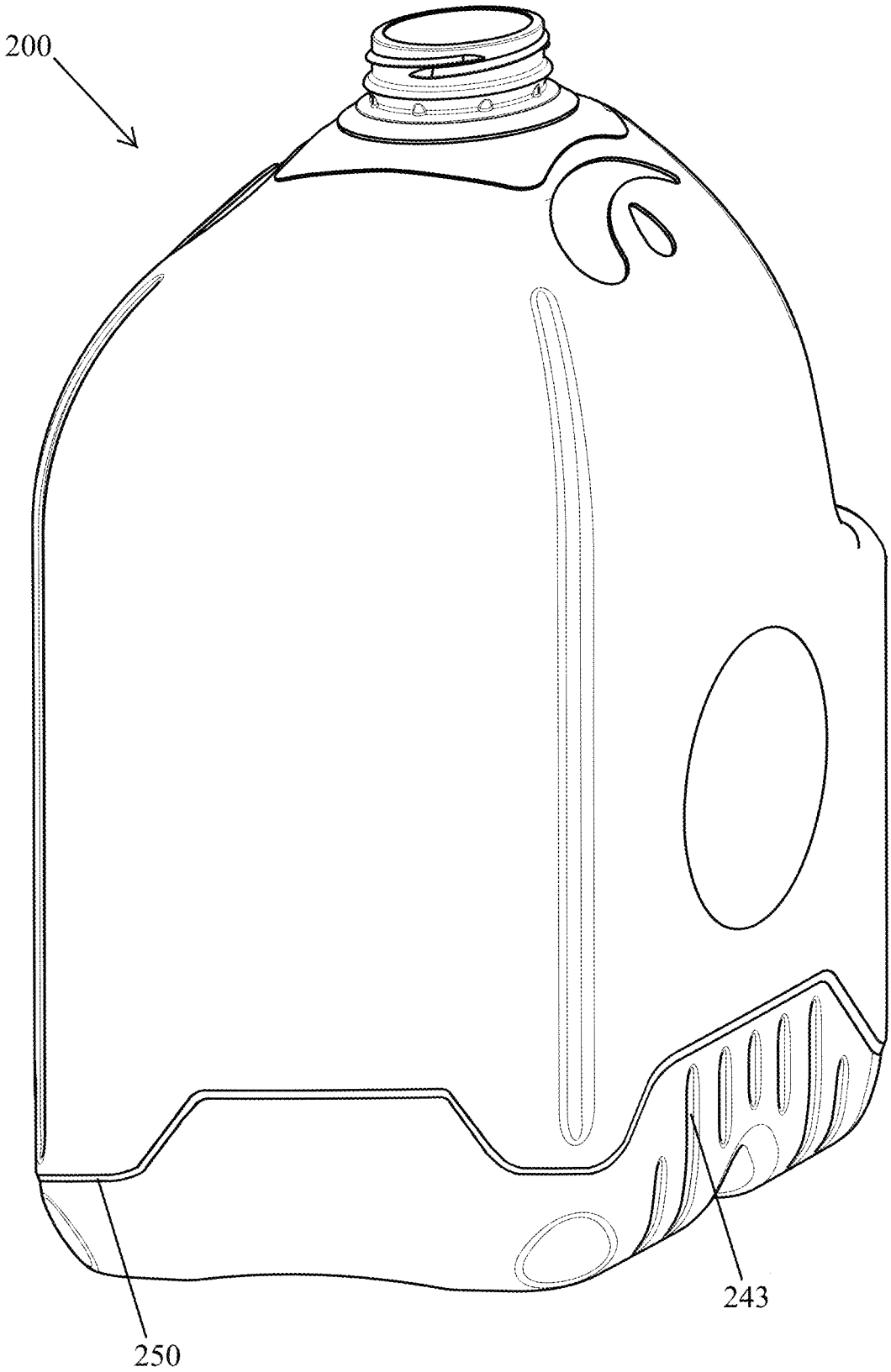
FIG. 7 is a rear perspective view of the liquid container illustrated in FIG. 6.

Referring now to the exemplary embodiment of FIGS. 6 and 7, another exemplary liquid container 200 is illustrated having a lower lip 250 and a plurality of ridges 243. Lower lip 250 may extend around the perimeter of container 200, forming an arch at the sides and back thereof. It is to be appreciated, however, that a lip may extend around, or may be arched along, only a portion of a container. For example, a lip may be disposed (and arched) only at the sides of a container, the sides and back, the back and front, or the back wall, and other variations thereof. In some embodiments, a lip may be symmetrical or asymmetrical. For example, a lip may be relatively lower (i.e., closer to the bottom of a container) near a corner edge of a container and relatively higher near an adjacent corner edge.

In contrast with FIGS. 1 and 5, in some embodiments a container may have a plurality of ridges which may be non-uniform (i.e., varying in length and/or width). For example, as further illustrated in FIGS. 6 and 7, a horizontal bottom edge 240 (which may be defined as being between lower lip 250 and the bottom of container 200), may have a plurality of ridges 243 of various lengths which may generally form the shape of an arch. It is to be appreciated, however, that a container may have any number, shapes, and sizes of ridges, lips, recesses, protrusions, or the like.

Figure 8:
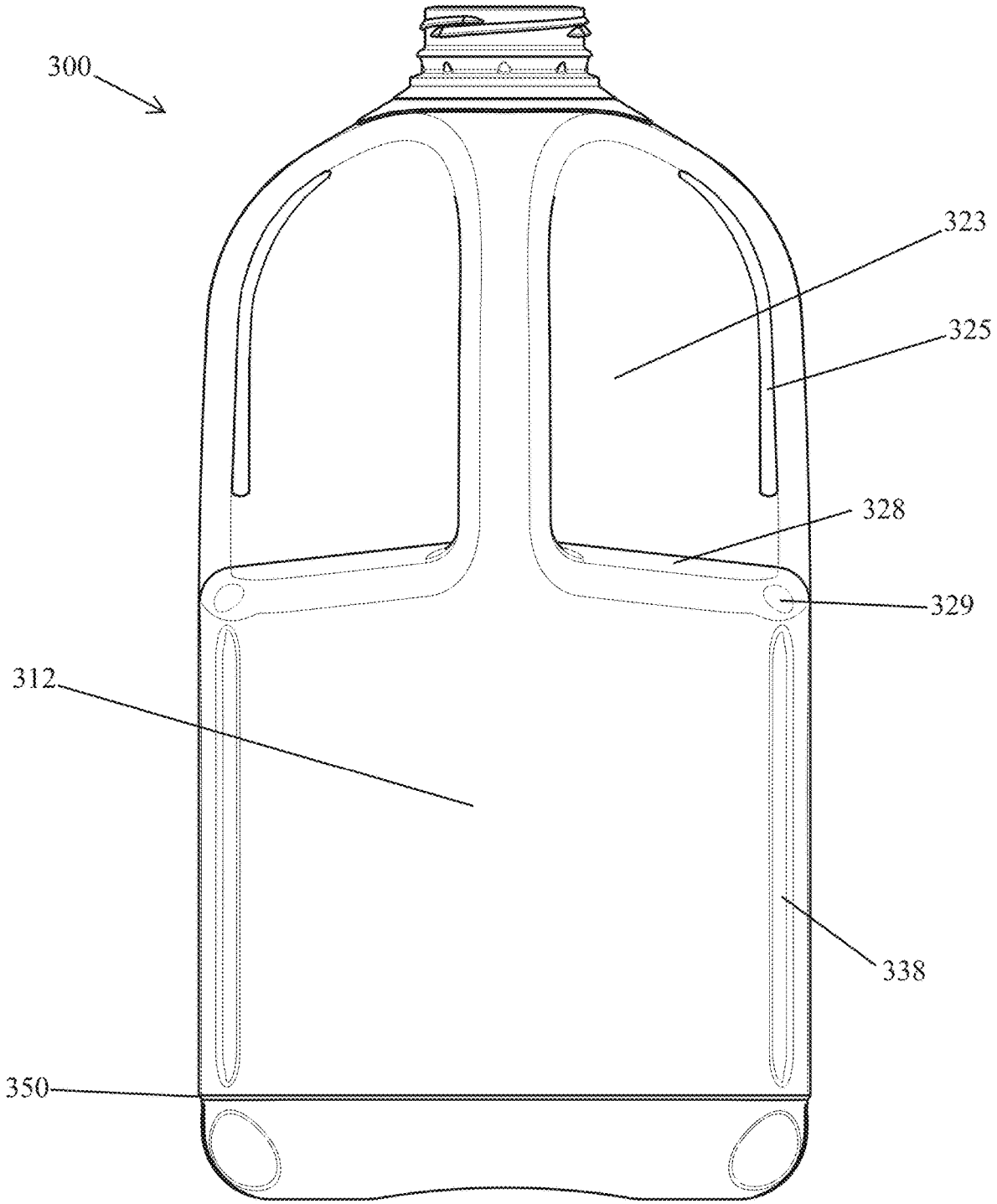
FIG. 8 is a front view diagram illustrating an exemplary liquid container in accordance with some embodiments of the present invention.
Figure 9:
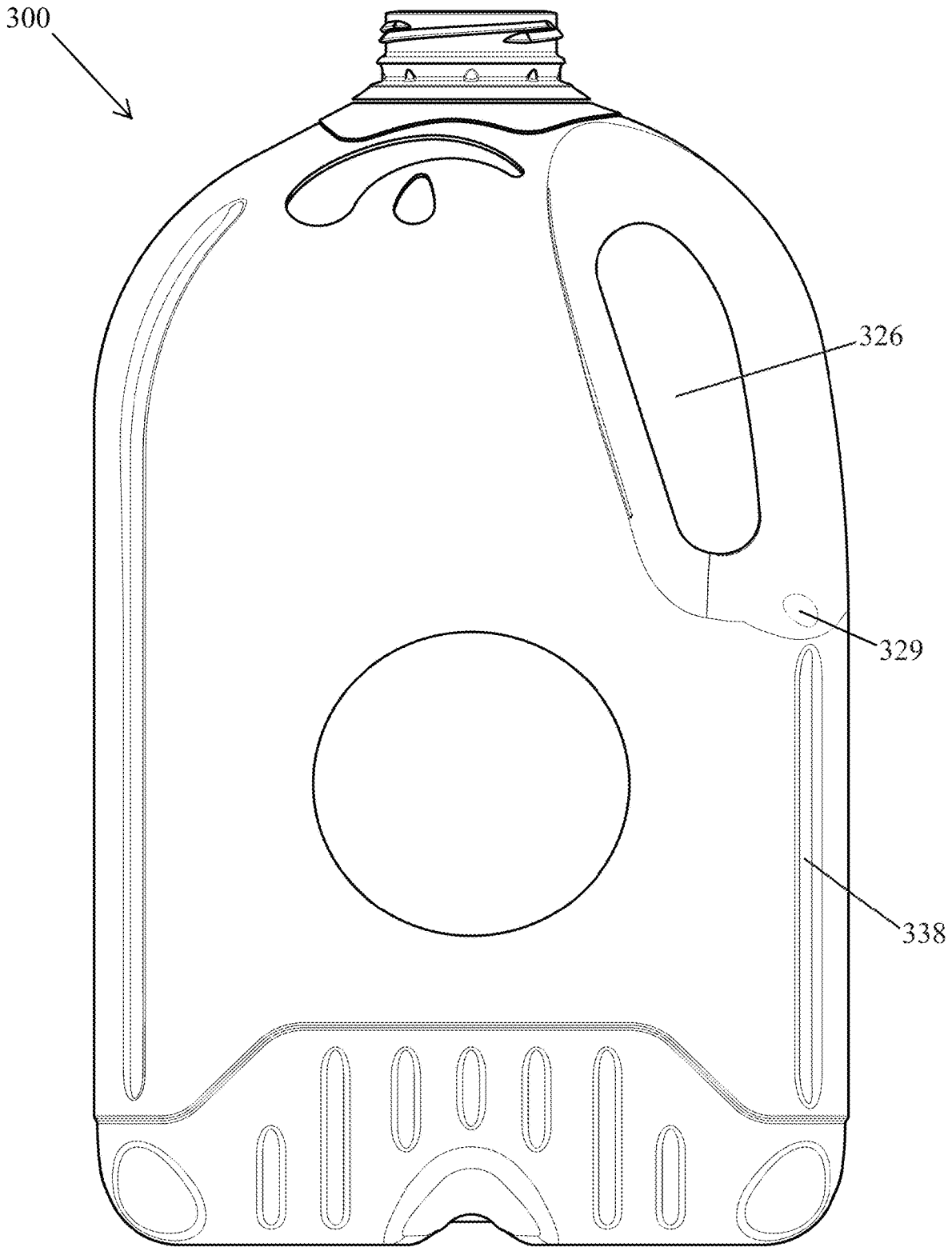
FIG. 9 is a side view diagram illustrating the liquid container of FIG. 8.
Figure 10:
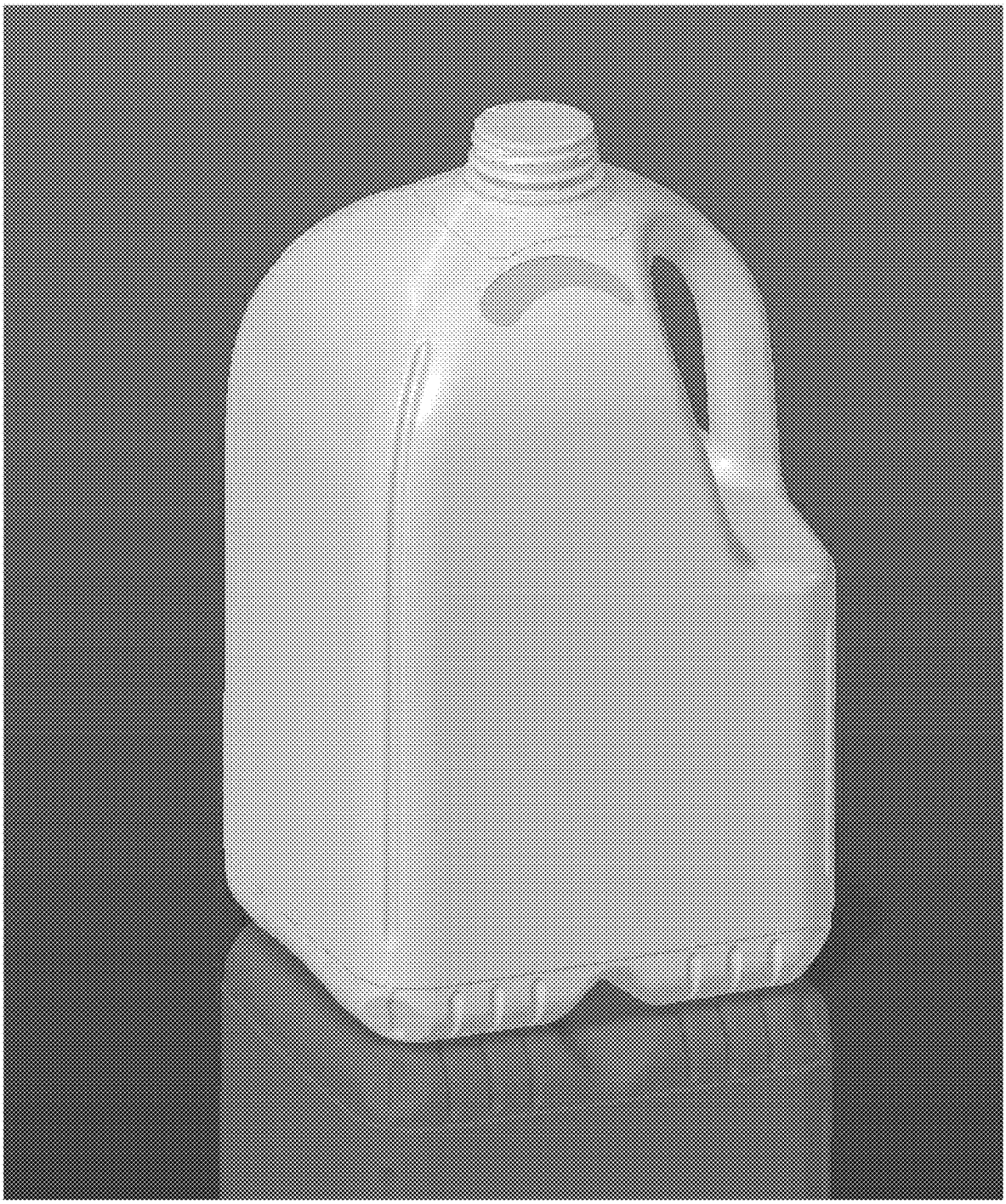
FIG. 10 is a side perspective view diagram illustrating an exemplary liquid container in accordance with some embodiments of the present invention.
Figure 11:
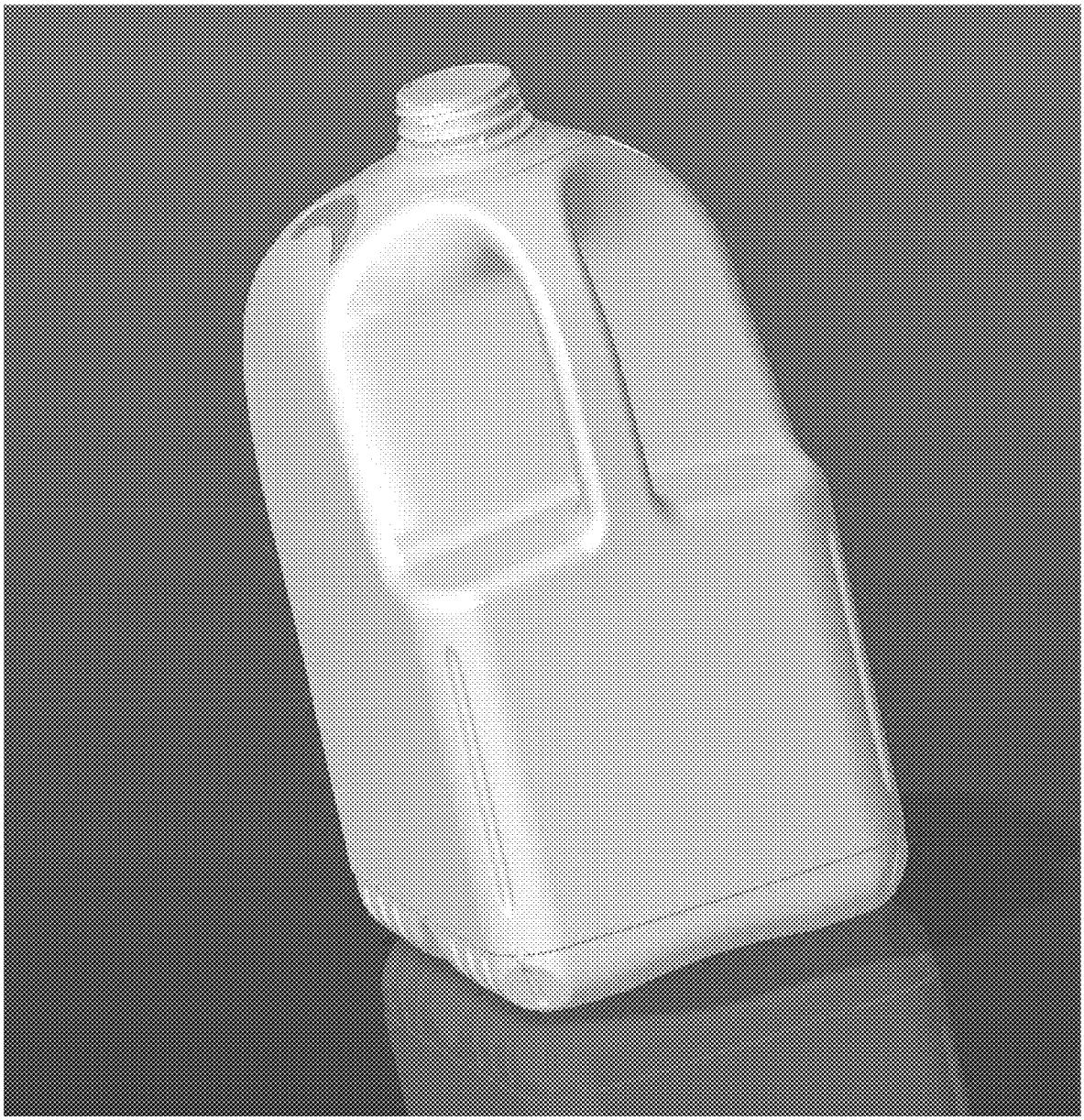
FIG. 11 is a front perspective view diagram illustrating an exemplary liquid container in accordance with some embodiments of the present invention.

According to some embodiments of the present invention, one or more ridges may be integrally formed with a wall of a cut-out portion. For example, referring, generally, to the exemplary embodiment illustrated in FIGS. 8 and 9, a container 300 may have ridges 325 formed in an upper wall 323 formed by a cut-out portion 326. In preferred embodiments, a ridge may be formed along, or near, a vertical edge of the upper wall of the cut-out portion (above the step), as illustrated, for example, in FIG. 8. A ridge may be straight or curved, or combinations thereof. In some embodiments, a width which may increase or decrease toward a distal end of a ridge. For example, as best illustrated in FIG. 8, a lower portion of ridges 325 may be generally straight (i.e., the portion closest to step 328), transitioning to a curved shape near approximately a vertical midpoint, with an upper portion of ridges 325 (i.e., the portion closest to the top of container 300) being curved and having a smaller width relative to the lower portion of ridges 325. In preferred embodiments, the curvature of a ridge may generally follow the curvature of an adjacent surface or edge of the container. For example, as further illustrated in FIG. 8, the curvature of ridge 325 may approximately follow the curvature of the top of container 300 such that ridge 325 is about parallel to the lateral surface of the top of container 300.

In some embodiments, one or more chamfered or beveled edges and/or corners may be formed on a step of a container. For example, as further illustrated in FIGS. 8 and 9, step 328 of container 300 may have chamfered corners 329, one at each intersection between step 328 and the vertical edges of front wall 312. Container 300 may also have an elongated ridges 338 which may extend from just below chamfered corners 329 to just above a lip 350. In comparison to, for example, FIG. 2, elongated ridges 338 may extend across a greater length of front wall 312 relative to elongated ridges 38 of front wall 12 of container 10.

It is to be understood that variations, modifications, and permutations of embodiments of the present invention may be made without departing from the scope thereof. It is also to be understood that the present invention is not limited by the specific embodiments, descriptions, or illustrations or combinations of either components or steps disclosed herein. Thus, although reference has been made to the accompanying figures, it is to be appreciated that these figures are exemplary and are not meant to limit the scope of the invention.

What is claimed is:

1. A self-supporting container for storing liquids comprising:

a) a top, said top having a wall with an integrally formed pour spout;

b) a body comprising a front, a back, a first side, and a second side, each of said front, back, first side, and second side having a wall, wherein said front wall and said back wall are each perpendicular to said first side wall and said second side wall;

c) a handle medially disposed on said front of said container between said top wall and said front wall, wherein a width of said handle increases near said top wall and said front wall;

d) a bottom having a substantially rectangular perimeter and comprising a first leg and a second leg extending from a bottom wall;

e) a plurality of rounded vertical edges, wherein a first, second, third, and fourth of said vertical edges are defined at an intersection between said front wall and said first side wall, said front wall and said second side wall, said back wall and said first side wall, and said back end and said second side, respectively;

f) a plurality of rounded horizontal bottom edges, wherein a first, second, third, and fourth of said bottom edges are defined at an intersection between said bottom wall and said first side wall, said front wall, said second side wall, and said back wall, respectively;

g) a lip extending along a perimeter of said container, wherein on at least one of the group consisting of said front wall, said back wall, said first side wall, and said second side wall, said lip forms an arch and wherein a distance from said lip to said bottom edge at each vertical edge of said wall is less than a distance from said lip to said bottom edge at a midpoint of said wall;

h) at least one recess formed in said top wall between said pour spout and at least one of the group consisting of said front wall, said back wall, said first side wall, and said second side wall; and i) a collar formed in said top wall between said at least one recess said pour spout, wherein said collar comprises at least one lip encircling said pour spout;

wherein at least one of said bottom edges comprises at least one integrally formed ridge disposed between said bottom wall and said lip extending along said perimeter of said container, wherein at least one of said bottom edges comprises at least one chamfered corner, and wherein at least one of said vertical edges comprises at least one integrally formed ridge.

2. The container of claim 1, wherein said at least one chamfered comer of said at least one of said bottom edges further comprises at least one integrally formed ridge.

3. The container of claim 1, wherein said bottom comprises a cavity extending from a midpoint of said first side to a midpoint of said second side and along a centerline of said bottom.

4. The container of claim 1, wherein a cavity is formed between said first leg and said second leg of said bottom.

5. The container of claim 1, wherein said bottom comprises an arch extending from a midpoint of said front to a midpoint of said back and along a centerline of said bottom.

6. The container of claim 1, wherein said handle further comprises a recess.

7. The container of claim 1, wherein said lip extending along said perimeter of said container forms a first arch, a second arch, and a third arch, wherein said first arch is disposed at said first side of said body, wherein said second arch is disposed at said second side of said body, and wherein said third arch is disposed at said back of said body.

8. The container of claim 1, further comprising a cut-out portion in said front wall, said cut-out portion forming an upper wall and a step.

9. The container of claim 8, wherein said upper wall comprises at least one integrally formed ridge.

10. The container of claim 9, wherein said at least one integrally formed ridge is disposed above said step.

11. The container of claim 8, wherein said step comprises at least one chamfered corner.

12. A container for liquid adapted to be displayed on a shelf, said container comprising:

a) a top wall with an integrally formed pour spout;

b) a bottom wall comprising a first leg and a second leg extending therefrom;

c) a front wall and a back wall between said top wall and said bottom wall;

d) a first side wall and a second side wall, each between said top wall and said bottom wall, wherein said first side wall and said second side wall are each perpendicular to said front wall;

e) a lip extending along a perimeter of said container, wherein on each of said first side wall, said second side wall, and said back wall, said lip forms an arch and wherein a distance from said lip to said bottom wall at a vertical edge of said wall is less than at a midpoint of said wall;

f) a handle having a top portion integrally formed with said top wall near said pour spout and a bottom portion integrally formed with said front wall;

g) at least one integrally formed ridge;

h) at least one recess formed in said top wall between said pour spout and at least one of said front wall, said back wall, said first side wall, and said second side wall; and i) a collar formed in said top wall between said at least one recess and said pour spout, wherein said collar comprises at least one lip encircling said pour spout;

wherein said handle extends perpendicular to said front wall and said bottom portion of said handle is about equidistant from said first side wall and said second side wall, wherein said bottom wall comprises at least one integrally formed ridge disposed below said lip extending along said perimeter of said container, wherein said bottom wall comprises at least one chamfered corner.

13. The container of claim 12, wherein said at least one chamfered corner of said bottom wall further comprises at least one integrally formed ridge.

14. The container of claim 12, wherein said bottom wall comprises a cavity extending from said midpoint of said first side wall to said midpoint of said second side wall and along a centerline of said bottom wall.

15. The container of claim 12, wherein a cavity is formed between said first leg and said second leg of said bottom wall.

16. The container of claim 12, wherein said bottom wall comprises an arch extending from a midpoint of said front wall to said midpoint of said back wall and along a centerline of said bottom wall.

17. The container of claim 12, further comprising a cut-out portion, said cut-out portion forming an upper wall and a step, wherein said upper wall is between said top wall and said step.

18. The container of claim 17, wherein said upper wall comprises at least one integrally formed ridge.

19. The container of claim 18, wherein said at least one integrally formed ridge is disposed above said step.

20. The container of claim 17, wherein said step comprises at least one chamfered corner.

21. A liquid container having a top wall with an integrally formed pour spout, a bottom wall, a front wall, a back wall, a first side wall, and a second side wall, and comprising a plurality of rounded vertical edges and a plurality of rounded horizontal bottom edges, wherein a first, second, third, and fourth of said vertical edges are defined at an intersection between said front wall and said first side wall, said front wall and said second side wall, said back wall and said first side wall, and said back end and said second side, respectively, wherein a first, second, third, and fourth of said bottom edges are defined at an intersection between said bottom wall and said first side wall, said front wall, said second side wall, and said back wall, respectively, and wherein said container is adapted to be displayed on a shelf, said container comprising:

a) a lip extending along a perimeter of said container, said lip forming at least one arch, wherein said at least one arch is on at least one of the group consisting of said front wall, said back wall, said first side wall, and said second side wall and wherein a distance from said lip extending along said perimeter of said container to said bottom edge at each vertical edge of said wall is less than a distance from said lip to said bottom edge at a midpoint of said wall;

b) at least one recess formed in said top wall of said container between said pour spout and at least one of the group consisting of said front wall, said back wall, said first side wall, and said second side wall;

c) a collar formed in said top wall between said at least one recess and said pour spout, wherein said collar comprises at least one lip encircling said pour spout; and d) a cut-out portion in said front wall, said cut-out portion forming a handle, an upper wall, and a step, wherein said upper wall comprises at least one integrally formed ridge disposed above said step and near a lateral edge of said upper wall and wherein said step comprises at least one chamfered corner disposed near an intersection between said step and at least one of the group consisting of said first side wall and said second side wall.

22. The container of claim 21, wherein at least one of said bottom edges comprises at least one integrally formed ridge disposed between said bottom wall of said container and said lip extending along said perimeter of said container.

23. The container of claim 21, wherein said at least one arch comprises a first arch on said first side wall of said container.

24. The container of claim 23, wherein said at least one arch further comprises a second arch on said second side wall of said container.

25. The container of claim 24, wherein said at least one arch further comprises a third arch on said back wall of said container.

* * * * *